United States Patent [19]

Hylwa

[11] Patent Number: 5,012,968

[45] Date of Patent: May 7, 1991

[54] DEVICE FOR CONTROLLING ACCESS IN FASTENER MANIPULATION SYSTEMS

[75] Inventor: William Hylwa, Ansonia, Conn.

[73] Assignee: Emhart Industries, Inc., Towson, Md.

[21] Appl. No.: 359,291

[22] Filed: May 31, 1989

[51] Int. Cl.[5] ..... B21J 15/38

[52] U.S. Cl. ..... 227/156; 29/812.5; 227/112

[58] Field of Search ..... 29/812.5; 227/112, 156

[56] References Cited

U.S. PATENT DOCUMENTS

| | | | |
|---|---|---|---|
| 3,415,102 | 12/1968 | Elliott | 29/812.5 X |
| 4,586,362 | 5/1986 | Deon et al. | 227/112 |
| 4,592,136 | 6/1986 | Hirsch | 29/812.5 |
| 4,662,206 | 5/1987 | Mauer et al. | 227/112 X |
| 4,747,294 | 5/1988 | Schwartz et al. | 227/112 X |
| 4,754,643 | 7/1988 | Weeks, Jr. et al. | 227/112 X |
| 4,765,175 | 8/1988 | Denham et al. | 227/112 X |

FOREIGN PATENT DOCUMENTS

| | | | |
|---|---|---|---|
| 2113718 | 9/1971 | Fed. Rep. of Germany | 29/812.5 |
| 3408687 | 9/1985 | Fed. Rep. of Germany | 29/812.5 |

*Primary Examiner*—Paul A. Bell
*Attorney, Agent, or Firm*—Spencer T. Smith

[57] ABSTRACT

A device for controlling access to an actuator of a fastener manipulation system as described. The device includes a discriminator which cooperates with moveable elements to allow access of authorized objects and to prevent operation of the actuator upon insertion of unauthorized objects.

4 Claims, 3 Drawing Sheets

DEVICE FOR CONTROLLING ACCESS IN FASTENER MANIPULATION SYSTEMS

BACKGROUND OF THE INVENTION

1. Field of the Invention

The invention relates to fastener manipulation systems, such as fastener presentation or setting devices, and more particularly to a device for controlling access to an actuator of a fastener manipulation system.

2. Description of the Prior Art

In U.S. Pat. No. 4,592,136, a fastener presentation device is described. The device includes a rotary drum to raise fasteners upward for deposit on a chute, an escapement mechanism to feed a single fastener at a time from the chute to a ramp for positioning the fastener in a driving mechanism which inserts the fastener into the nosepiece of a fastener application tool. A user inserts the fastener application tool into an opening in the presentation device and thereby trips an actuator switch, which in turn operates the driving mechanism. The driving mechanism pushes the fastener into the nosepiece of the tool. Other fastener manipulation devices are described in U.S. Pat. No. 3,415,102, U.S Pat. No. 4,754,643, U.S. Pat. No. 4,747,294, and U.S. Pat. No. 4,662,206 and U.S. Pat. No. 4,586,362.

A common problem with such devices is that of unauthorized access to the actuator thereby operating the device at an inopportune time or with an inappropriate tool. For example, fingers or screwdrivers may be inserted into an opening the device and accidentally operate the device, which would result in injury. Also, the device could be operated in connection with an improper tool for the particular application. A common solution to this problem is to display a warning in the vicinity of the opening against inserting fingers or unauthorized devices such as screwdrivers, or the like, into the opening. Such a warning, however, maybe misread, misunderstood, or even ignored.

SUMMARY OF THE INVENTION

It is an object of the invention to provide a device for controlling access to an actuator of a fastener manipulation system. The device includes sensing for the insertion of objects in proximity to the actuator, determining whether or not the object is authorized or not and operating the actuator responsive to the insertion of an authorized object.

DESCRIPTION OF THE PREFERRED EMBODIMENT

A device for controlling access to an actuator of a fastener manipulation system is utilized with systems such as fastener presentation devices, fastener setting devices, fastener transporting devices or automatic fastener presentation and setting systems which include elements of all of these. Systems of this sort are commonly utilized to handle fasteners such as blind rivets, blind nuts, screws, nails, stud welding, threaded inserts, and the like. It is preferred to utilize the device of the present invention with blind rivet presentation and setting devices of the type in which a rivet setting or application mechanism is inserted into an opening wherein a rivet is inserted into the application or setting mechanism upon the tripping of an actuator.

Figure 1:
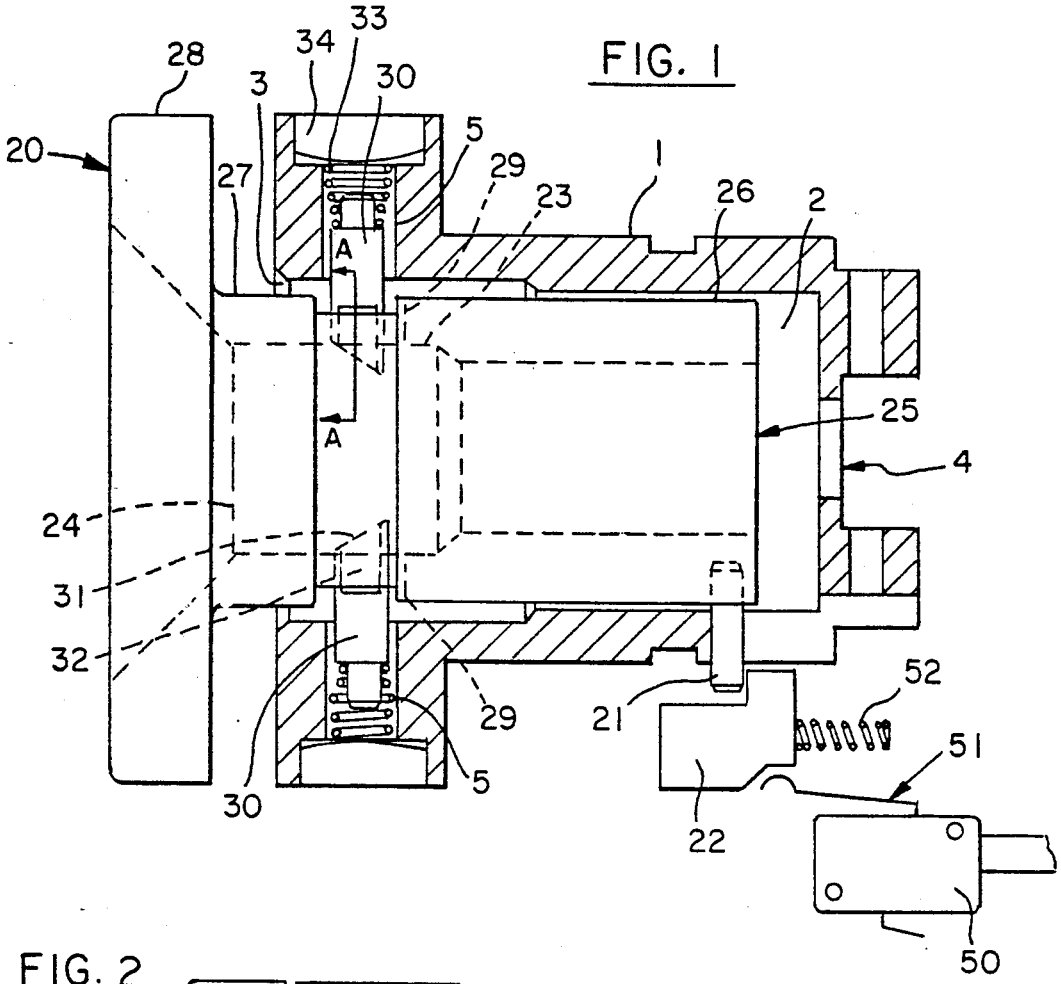
FIG. 1 is a side plan view of one embodiment of a device according to the present invention showing moveable elements in a fully extended position.

Referring to FIG. 1, a housing (1) is provided with a central aperture (2) extending therethrough and having an opening (3) on one end which is sized to contain a discriminator (20) and having an opening (4) at the opposite end sized to allow a fastener, for example, a blind rivet to be axially transported through. Housing (1) is also provided with two or more apertures (5) positioned transverse to the center line of central aperture (2) and adapted to contain moveable elements (30). A slot is provided allow discriminator (20) to operate actuator (50) by contact of pin (21) and operator (22) with actuator arm (51). Spring (52) engages operator (22) to return discriminator (20) to the advanced position. Housing (1) and central aperture (2) may be generally cylindrical in shape; however, other shapes such as square, rectangular, etc. may also be employed.

Figure 2:
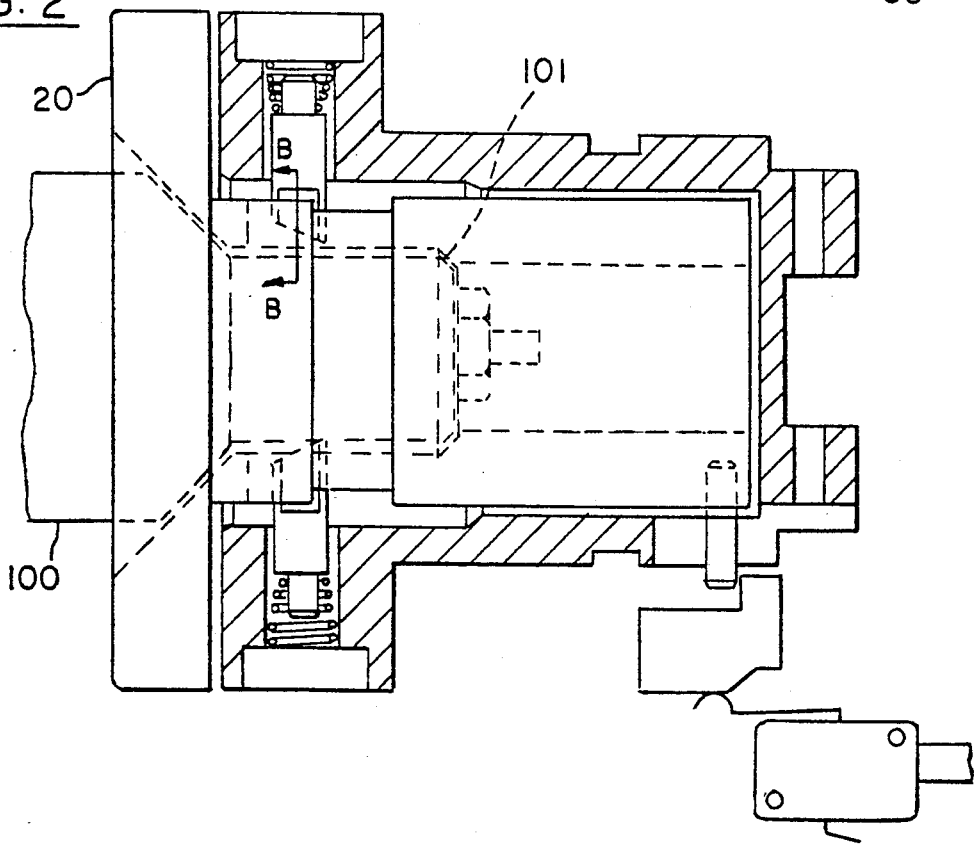
FIG. 2 is a side plan view of the device of FIG. 1 showing moveable elements in a retracted position.
Figure 3:
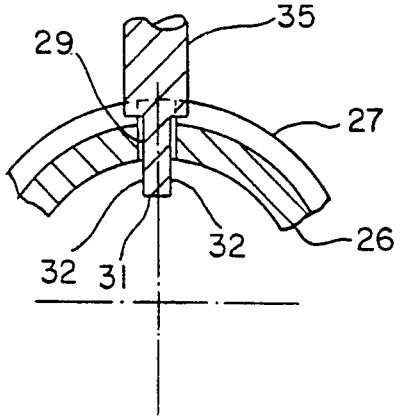
FIG. 3 is a sectional view taken along line A—A of FIG. 1.

Discriminator (20) is positioned inside central aperture (2) of housing (1) and adapted to move axially between advanced and retracted positions. FIG. 1 shows discriminator (20) in the advanced position and FIG. 2 shows discriminator (20) in the retracted position. Discriminator (20) also contains an aperture (23) extending therethrough and having an entrance opening (24) sized to receive a fastener application or setting device (100) and having an opening (25) at the opposite end sized to allow a fastener to be axially transported therethrough. Discriminator (20) includes a main body section (26), shoulder section (27) and entrance flange section (28). Slots (29) are positioned to bridge shoulder section (27) and main body section (26) and are parallel with the direction of movement of discriminator (20). Slots (29) are sized to permit a lower portion of moveable elements (30) to extend therethrough. Discriminator (20) and is positioned such that main body section (26) fits within central aperture (2) and that slots (29) are aligned with apertures (5) of housing (1).

Figure 5:
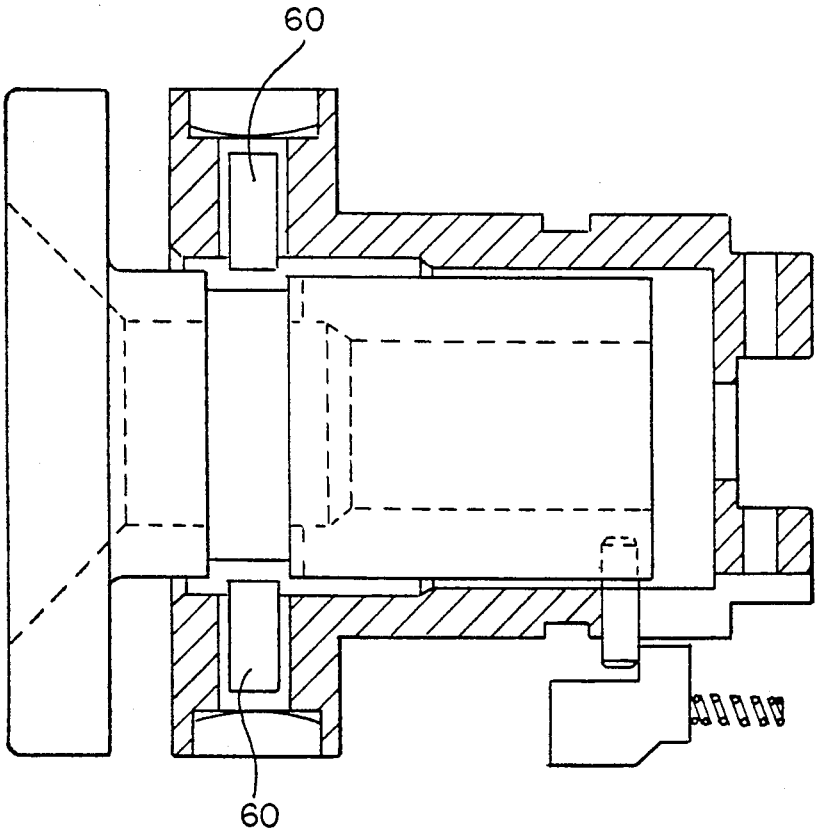
FIG. 5 is a side plan view of another embodiment of a device of the present invention showing static sensors instead of moveable elements.

Moveable elements (30) are located within apertures (5) of housing (1) and have a lower section which fits through slots (29) of discriminator (20). Moveable elements (30) may have any desired configuration such as spring loaded plungers, or cantilever springs, but preferably are truncated cylinders with chordal side faces (32). The chordal side faces (32) are sized to fit within slots (29). The truncated end of the cylinder presents a sloping surface (31) which is positioned to face entrance flange section (28) and entrance opening (24). Moveable elements (30) are pre-loaded or biased inwardly by springs (33) acting against stop (34) Referring to FIG. 5, moveable elements (30) may be replaced with static sensors (60) such as proximity sensors, optical sensors, read switches, magnetic sensors, infra-red sensors, photo-detector sensors, pneumatic sensors, or the like. Static sensors (60) can provide two functions, that of sensing as well as that of actuating and effectively replace actuator (50), as is known in the art.

Figure 4:
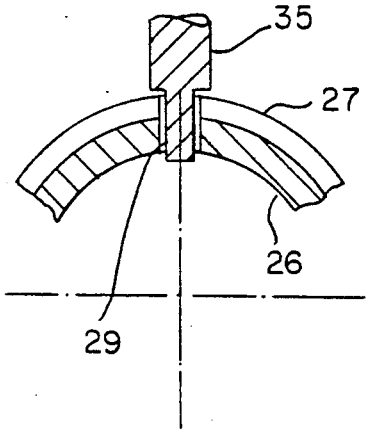
FIG. 4 is a sectional view taken along line B—B of FIG. 2.

Referring to FIGS. 2 and 4, the operation of the device will be described in greater detail. As an authorized fastener setting tool (100) is inserted into the entrance opening (24) of discriminator (20), it fits through entrance opening (24) and then encounters moveable elements (30). If mating surfaces (101) of tool (100) are of a compatible angle with surfaces (32) of moveable elements (30), moveable elements (30) will be displaced. This initial displacement allows tool (100) to continue past moveable elements (30) and be inserted further into aperture (23) of discriminator (20). As tool (100) continues to be inserted, moveable elements (30) are displaced a predetermined distance such that the main body (35) of moveable element (30) is displaced a sufficient distance to clear shoulder section (27). This in turn allows discriminator (20) to move from the advanced to the retracted position. When discriminator (20) reaches the retracted position, pin (21) pushes operator (22) to depress switch (51) of actuator (50). When actuator (50) is operated, typically a fastener is transported through openings (4) and (25) and to the setting device (100), which grips the fastener and removes it from the device as it is itself removed.

The sequence of events is changed if an unauthorized device is attempted to be inserted. Firstly, the diameter and internal configuration of entrance opening (24) prevents entry of objects which are too large. Second, if an object is inserted which does not have mating surfaces compatible with surfaces (31) of moveable elements (30), the moveable elements will not be displaced and the object will not be capable of insertion any further. Third, if an object is inserted (e.g. a screwdriver or a finger) which does not simultaneously displace all moveable elements (30) the predetermined distance such that main body (35) of the elements is beyond shoulder section (27) of discriminator (20), the discriminator will be unable to move from the advanced to the retracted position and the pin (21) will be unable to operate actuator (50).

I claim:

1. A device for providing controlled access to an actuator of a fastener manipulations system comprising a cylindrical housing, a control switch, a discriminator located within said cylindrical housing and having actuator means extending through said housing, said discriminator being selectively axially displaceable from a first position whereat said actuator means is remote from said control switch to a second position whereat said actuator means actuates said control switch, said discriminator having a selectively configured axial bore for receiving a cylindrical fastener setting tool opposed latch means carried by said cylindrical housing and radially displaceable between retracted and advanced positions for preventing displacement of said discriminator from said first position to said second position when in said advanced position and for permitting displacement of said discriminator from said first position to said second position when in said retracted position, said latch means being selectively configured so that engagement with opposed portions of the fastener setting tool as it is inserted into said discriminator will result in displacement of each of said latch means from said advanced to said retracted position.

2. A device according to claim 1, wherein each of said latch means includes a beveled surface for cooperating with a beveled annular surface of a rivet fastening tool.

3. A device according to claim 2, wherein each of said latch means includes an upper portion and a reduced diameter lower portion and said discriminator includes selectively configured slots for receiving said reduced diameter portions when each of said latch means is displaced to said retracted position thereby permitting axial displacement of said discriminator.

4. A device for providing controlled access to an actuator of a fastener manipulation system which comprises:

a housing having a central aperture for containing a discriminator and two or more apertures for containing moveable elements;

a discriminator located within the central aperture of the housing and adapted to be moveable in an axial direction and having a main body section, a shoulder section, and an entrance flange section, an entrance aperture extending therethrough accommodating and conforming to the shape of an approved fastener manipulation device, and radial slots parallel to the direction of movement of the discriminator and aligned with the apertures of the housing for containing moveable elements;

two more pre-loaded moveable elements positioned for radial displacement, said elements having a cut out portion and a main body portion and having an interface surface conforming to the approved fastener manipulation device; and whereby insertion of an approved fastener manipulation device displaces the moveable elements so that the main body portion clears the shoulder of the discriminator and allows the discriminator to move to a retracted position and thereby operate the actuator.

* * * * *